US006340320B1

(12) United States Patent
Ogawa

(10) Patent No.: US 6,340,320 B1
(45) Date of Patent: Jan. 22, 2002

(54) PROBE PIN ASSEMBLY, A METHOD OF MAKING THE SAME AND A CONNECTOR USING THE SAME

(75) Inventor: Shingo Ogawa, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/266,612

(22) Filed: Mar. 11, 1999

(30) Foreign Application Priority Data

Dec. 18, 1998 (JP) ..... 10-360557

(51) Int. Cl.[7] ..... H01R 13/24
(52) U.S. Cl. ..... 439/824; 439/700; 29/511
(58) Field of Search ..... 439/824, 700, 439/886; 29/511

(56) References Cited

U.S. PATENT DOCUMENTS 2,438,350 A * 3/1948 Reichard ..... 439/219
4,580,856 A * 4/1986 Westover et al. ..... 439/34
4,603,329 A * 7/1986 Bangerter et al. ..... 340/679
4,614,388 A * 9/1986 Powell ..... 439/82
4,669,185 A * 6/1987 Westover et al. ..... 29/82
5,044,993 A * 9/1991 El-Haj et al. ..... 439/668
5,461,326 A * 10/1995 Woith et al. ..... 439/482
5,482,038 A * 1/1996 Ruff ..... 439/482

* cited by examiner

*Primary Examiner*—Renee Luebke
*Assistant Examiner*—Briggitte R. Hammond
(74) *Attorney, Agent, or Firm*—Arent Fox Kintner Plotkin & Kahn, PLLC

(57) ABSTRACT

Disclosed are an improved probe pin assembly and a method of making the same. Each probe pin uses a sleeve which is formed by stamping and deep-drawing a thin sheet of metal with dies. The sleeve has a contact pin slidably fitted therein, a resilient member contained therein to spring-bias the contact pin with its tip end appearing from the sleeve and a cover plate fastened to and closing the rear opening of the sleeve.

2 Claims, 4 Drawing Sheets

PROBE PIN ASSEMBLY, A METHOD OF MAKING THE SAME AND A CONNECTOR USING THE SAME

BACKGROUND OF THE INVENTION

1. Field of the Invention

The present invention relates to a connector having a probe pin assembly embedded in its insulating housing such as used in cellular phones, electric devices for domestic use or personal computers. Also, the present invention relates to a probe pin assembly for such a connector and a method of making the same.

2. Description of Related Art

Referring to FIG. 7, a conventional connector 20 has a probe pin assembly 1 embedded in its insulating housing mold 13. The probe pin assembly 1 comprises a plurality of contact pins 11, which are spring-biased to permit their tip ends to appear from the sleeves 6*a* and the insulating housing mold 13. In an attempt to reduce the connector size the connector uses coiled springs 12 rather than spring plates.

As seen from the drawing, each metal sleeve 6*a* has a contact pin 11 slidably fitted therein, and a coiled spring 12 placed on its bottom. Thus, each contact pin 11 is so spring-biased axially that its tip end may appear from the sleeve 6*a*.

Probe pin assemblies are distinguished in terms of the leg shapes formed on the rear sides of their sleeves, as for instance, follows: surface-mounting type (SMT) of probe pin assembly (see FIG. 8); DIP type of probe pin assembly (see FIG. 9); and right-angled type of probe pin assembly, which has a post 21 bent at a right angle (see FIG. 10).

Sleeves are usually made by machining, and therefore, much time and cost are involved. As seen from FIG. 11, sleeves 6*a* and posts 22 are made separately, and these parts are combined together with caulking. Advantageously resultant products effectively prevent the rising of soldering material while being subjected to the dip-soldering process. Disadvantageously such structures require extra parts, and accordingly management and manufacturing costs increase.

SUMMARY OF THE INVENTION

One object of the present invention is to provide an improved probe pin assembly which is free of defects as described above.

Another object of the present invention is to provide a method of making such an improved probe pin assembly.

Still another object of the present invention is to provide a connector using such an improved probe pin assembly.

To attain these objects a probe pin assembly according to the present invention comprises: one or more sleeves which are formed by stamping and deep-drawing an elongated strip of thin metal sheet with dies; contact pins slidably fitted in the sleeves; resilient members contained in the sleeves to spring-bias the contact pins, thus allowing their tip ends to appear from the sleeves; and cover plates for closing the rear openings of the sleeves, thereby preventing the resilient members from spring out from the sleeves. The sleeves may be plated only the lower halves.

A method of making probe pin assemblies according to the present invention comprises the steps of: feeding an elongated strip of thin metal sheet to be stamped and deep-drawing sequentially, thus forming a series of sleeves, each having openings at its front and rear ends; inserting a contact pin from the rear side of each sleeve to permit its tip end to appear from the front end of the sleeve; putting a resilient member behind the contact pin in each sleeve; and applying a cover plate to the rear end of each sleeve and crimping the rear part of sleeve around the cover plate, thereby closing the sleeve on its rear side.

The method may include further steps of: rolling up the series of sleeves, and continuously feeding the sleeves to plate the inner and outer walls with gold while being unrolled after the step of forming a series of sleeves.

Further, the plating may be partial-plating to be made onto the lower halves of the sleeves to save of gold for reduction of manufacturing cost.

A connector according to the present invention comprises a probe pin assembly as described above and an insulating housing mold having the probe pin assembly embedded therein.

In making probe pin assemblies according to the present invention sleeves are made by making a series of holes in an elongated strip of thin metal sheet, and by deep-drawing such holes with dies, thus facilitating the making of sleeves, not requiring much time.

Still advantageously, the stamping permits sleeves of different shapes to be provided simply by selecting appropriate dies. Sleeves whose shape cannot be formed by machining can be provided easily by stamping a thin metal sheet with dies. A variety of sleeve shapes including DIP type of sleeve shapes or right-angled type of sleeve shapes can be formed by subjecting stamped objects to another pressing or bending process. The closing of the sleeve end with a stationary cover by caulking effectively prevents the rising and invading of soldering material into the sleeve.

An elongated strip of thin metal sheet can be rolled and unrolled in stamping sleeves and covers out of the thin metal sheet. Advantageously the rolling and unrolling facilitates automatization of making and assembling parts to probe pin assemblies. The thickness of sleeve material can be significantly reduced compared with sleeves produced by machining, thus better meeting a desire for reducing the thickness of cellular phones and other electronic devices.

The deep-drawing will cause appearance of almost invisible longitudinal scars on the inner surface of the sleeve, which longitudinal scars can reduce significantly the friction with which the contact pin slides on the inner surface of the sleeve.

There is a fear of causing cracks to appear on the post of the sleeve in bending if the sleeve is formed by machining. The sleeve which is formed by deep-drawing is quite free of such cracks.

The rolling and unrolling of an elongated strip of thin metal sheet permits partial-plating of sleeves with gold.

Other objects and advantages of the present invention will be understood from the following description of a probe pin assembly according to one preferred embodiment of the present invention, which is shown in accompanying drawings.

BRIEF DESCRIPTION OF THE DRAWINGS

FIG. 1A is a plane view of an elongated strip of thin metal sheet in stamping and deep-drawing the same whereas

FIG. 3A is a longitudinal section of the probe pin whereas

FIG. 5A is a longitudinal section of another probe pin whereas

DESCRIPTION OF THE PREFERRED EMBODIMENTS

Figure 1A:
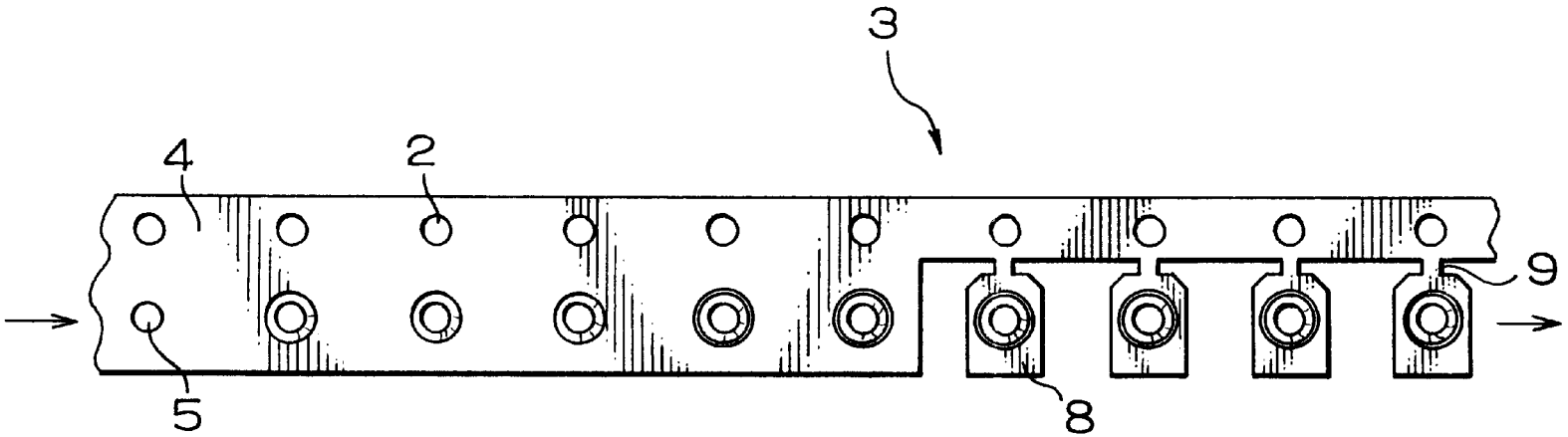
Figure 1B:
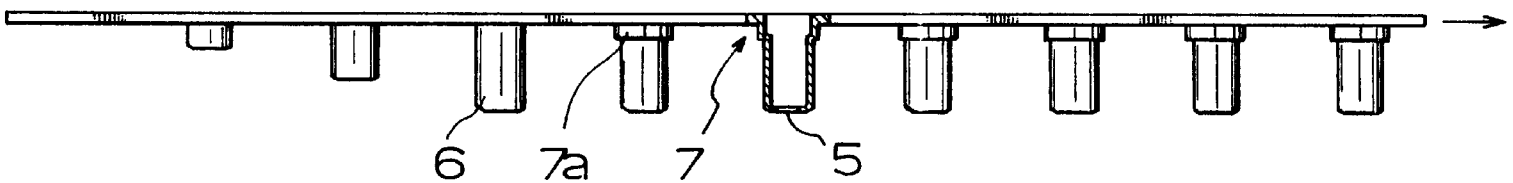
FIG. 1B is a side view of the elongated strip of thin metal sheet of FIG. 1A.

Referring to FIG. 1, an elongated strip of thin metal sheet 4 has a perforated edge 2 on one longitudinal side for feeding the thin metal sheet 4 in one direction. First, a hole 5 is made in the thin metal sheet 4. The hole 5 becomes the front opening of a sleeve 6 to be made. The portion around the hole 5 is drawn deeply with dies making the hole 5 center to form a sleeve 6.

The sleeve 6 thus formed is swaged to form a radial expansion 7*a* for accommodating a stationary cover. Then, the thin metal sheet 4 is cut to remove the surrounding area, leaving a rectangular flange 8 around the sleeve 6. A plurality of flanged sleeves 8 thus sequentially formed are connected to the perforated carrier strip 3 by joint pieces 9 and these sleeves are rolled up to be transferred to the next plating step.

Figure 2:
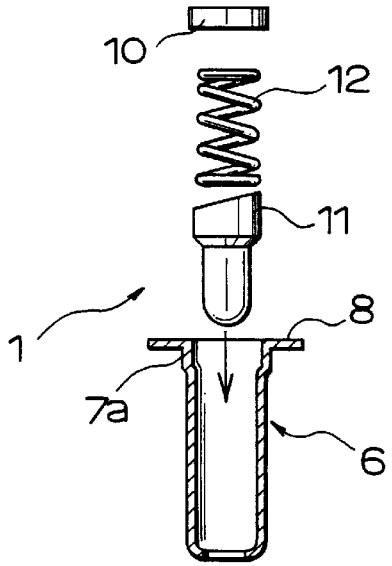
FIG. 2 illustrates how parts are assembled to a probe pin.

Then, these rolled flanged sleeves 6 are continuously fed to be plated the inner and outer walls with gold while being unrolled. The plating is a partial-plating onto the lower halves of the sleeves. On the other hand, a plurality of cover disks 10 are stamped out of another elongated strip of thin metal sheet while being fed longitudinally. As seen from FIG. 2, a contact pin 11 and a coiled spring 12 are inserted in each flanged sleeve 6, and then, a cover plate 10 is press-fitted in the swaged opening 7*a*. Then, the cover plate 10 is fastened to the sleeve 6 by crimping the swaged circumference around the cover plate 10.

Then, each sleeve 6 is separated from the carrier strip by cutting the joint piece 9. One or more sleeves 6 thus separated are put in a metal mold to be insert-molded by injecting a synthetic resin material into the metal mold. Then, a connector 14 having a sleeve 6 embedded in a housing mold 13 result.

Each gold-plated sleeve 6 is separated from the perforated carrier strip subsequent to loading it with a contact pin and a coiled spring and to closing the so loaded sleeve with a cover disk. Instead, each gold-plated sleeve 6 may be separated from the carrier strip 3, and then, sleeves thus separated may be loaded with contact pins 11 and coiled springs 12, and the so loaded sleeves may be closed with cover disks 10 by press-fitting the cover disks into the sleeves and by crimping their swaged ends around the cover disks 10. These works may be automatized.

Figure 3A:
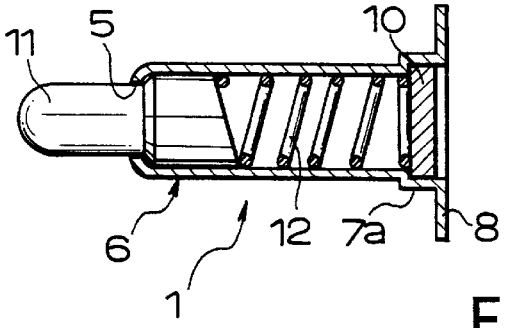
Figure 3B:
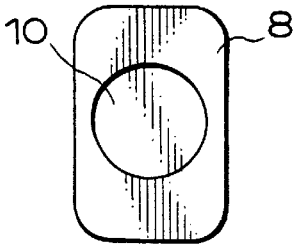
FIG. 3B is a bottom view of the probe pin.
Figure 4:
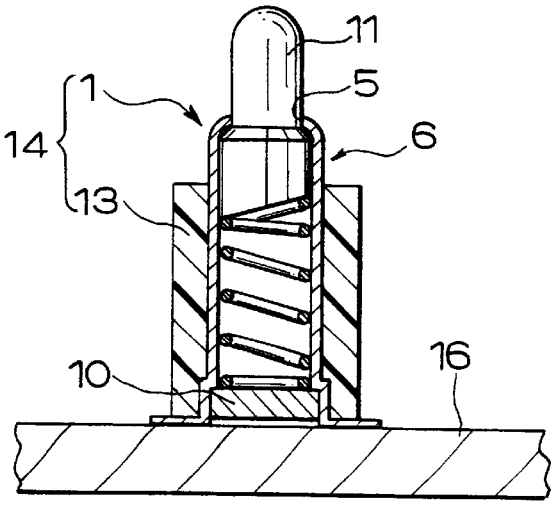
FIG. 4 illustrates how the probe pin is like in use.
Figure 5A:
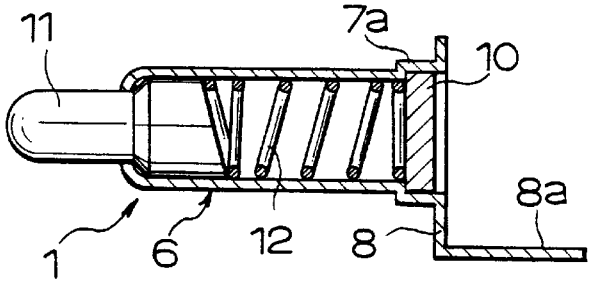
Figure 5B:
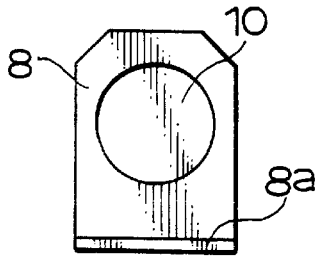
FIG. 5B is a bottom view thereof.
Figure 6:
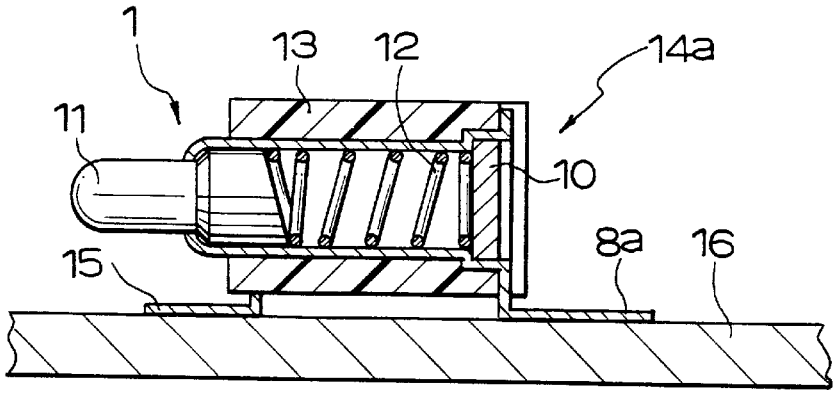
FIG. 6 illustrates how the probe pin assembly of FIG. 5 is like in use.
Figure 7:
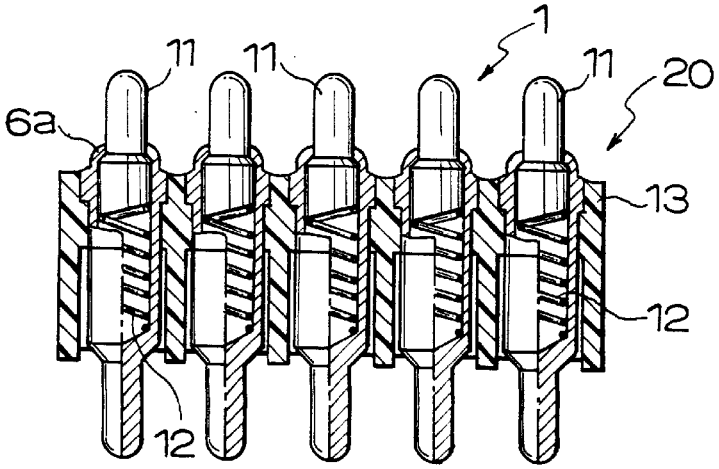
FIG. 7 PRIOR ART
FIG. 7 is a conventional probe pin assembly.
Figure 8:
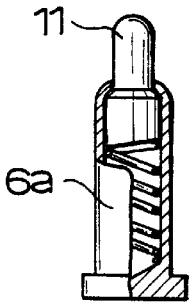
FIG. 8 PRIOR ART
FIG. 8 is an elevation of the conventional probe pin, partly broken to show the inside.
Figure 9:
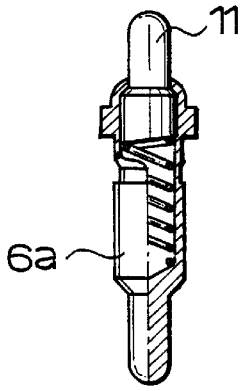
FIG. 9 PRIOR ART
FIG. 9 is an elevation of a conventional DIP-type of probe pin, partly broken to show the inside.
Figure 10:
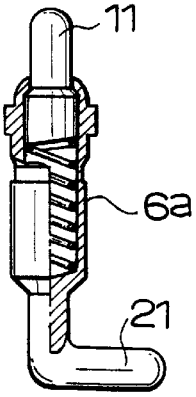
FIG. 10 PRIOR ART
FIG. 10 is an elevation of a conventional right-angled type of probe pin, partly broken to show the inside.

The connectors thus produced may be of surface-mounting type (SMT) as shown in FIGS. 3 and 4 or right-angled type as shown in FIGS. 5 and 6, where the connector 14*a* has its flange 8 bent at a right angle. FIG. 6 shows how the connector can be mounted on a circuit-printed board 16.

Figure 11A:
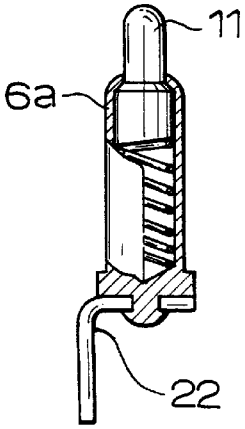
FIG. 11A PRIOR ART
FIGS. 11A and 11B are elevations of a conventional right-angled type of probe pin having a separate post integrally connected thereto, partly broken to show the inside.
Figure 11B:
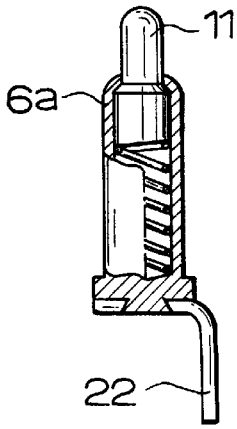
FIG. 11B PRIOR ART

A metal reinforce 15 may be used in mounting a connector (see FIG. 6). A connector can be formed to be of DIP-type by bending its flange 8 or joint piece 9 to provide a right-angled post such as indicated at 22 in FIG. 11.

As may be understood from the above, a plurality of sleeves are formed by stamping and deep-drawing a thin sheet of metal with dies. This facilitates the producing of sleeves, and accordingly the cost and time involved can be substantially reduced. Still advantageously, the stamping and deep-drawing of thin metal sheet with dies permits a variety of sleeve shapes to be produced, and sequential extra pressing permits further modifications of such sleeves to provide for examples, DIP-type or laid-flat type connectors. The deep-drawing causes appearance of hardly visible longitudinal scars extending in the same direction as the contact pin moves in the sleeve, thus reducing significantly the friction with which the contact pin moves in the sleeve.

Use of an elongated strip of thin metal sheet permits the rolling and unrolling of the material in the course of production, thus facilitates the automatization of all manufacturing and assembling processes.

Thanks to the use of thin metal sheet in producing sleeves the resultant sleeve can have a reduced thickness, thus better meeting an ever increasing demand for reduction of weight and thickness for instance in cellular phones. In producing right-angled probe pin assemblies there is no fear of causing appearance of cracks in their posts in bending, which cracks are prone to appear in producing right-angled probe pin assemblies according to the conventional method. Still advantageously, use of elongated strip of thin metal sheet facilitates the plating of inner surfaces of sleeves, which plating can be effected at selected places on the metal sheet in unrolling the elongated strip upstream of stamping and deep-drawing stations. Sleeves which are made by machining as in the conventional method cannot be gold-plated inside adequately without allowing the outside to be coated thick three times as much as inside. Thus saving of gold reduces significantly the manufacturing cost. The closing of sleeves with cover disks effectively prevents the rising-and-invading of soldering material in the sleeve.

What is claimed is:

1. A probe pin assembly comprising:

one or more sleeves which are formed by stamping and deep-drawing a thin sheet of metal with dies;

contact pins slidably fitted in the sleeves;

resilient members contained in the sleeves to spring-bias the contact pins with their tip ends appearing from the sleeves; and cover plates for closing rear openings of the sleeves, thereby preventing the resilient members from springing out from the sleeves wherein said sleeves are plated only on lower halves of said sleeves.

2. The probe pin assembly according to claim 1 further comprising an insulating housing mold having the probe pin assembly embedded therein.

* * * * *